United States Patent [19]

Graiff

[11] Patent Number: 4,666,529

[45] Date of Patent: May 19, 1987

[54] METHOD FOR REDUCING COMBUSTION CHAMBER DEPOSITS FROM AN INTERNAL COMBUSTION ENGINE

[75] Inventor: Leonard B. Graiff, Chester, England

[73] Assignee: Shell Oil Company, Houston, Tex.

[21] Appl. No.: 799,771

[22] Filed: Nov. 21, 1985

[51] Int. Cl.[4] ..... B08B 3/08

[52] U.S. Cl. ..... 134/20; 134/22.14; 134/39; 252/153; 252/162; 252/544

[58] Field of Search ..... 134/20, 22.14, 39; 252/544, 153, 162

[56] References Cited

U.S. PATENT DOCUMENTS

| | | | |
|---|---|---|---|
| 1,787,789 | 1/1931 | Lovell et al. | 134/20 |
| 1,936,682 | 11/1933 | Lovell et al. | 134/20 |
| 2,718,480 | 9/1955 | Lauer | 134/20 |
| 2,956,910 | 10/1960 | Giammaria | 134/20 |

*Primary Examiner*—Andrew H. Metz
*Assistant Examiner*—A. Pal
*Attorney, Agent, or Firm*—Kimbley L. Muller

[57] ABSTRACT

A method is disclosed for reducing combustion chamber deposits in an internal combustion engine by the passage of an aqueous deadhering agent such as water to the combustion chamber at cold start conditions and permitting the engine to crank for a period of time until said deposits deadhere from the walls of the combustion chamber. The aqueous deadhering agent can be water or the same with a diluent, such as a lower alkyl ketone. This invention is applicable to combustion chamber deposits which have resulted from the use of an additive agent, such as an amine-urea type detergent additive in as low a concentration in gasoline fuel as 50 ppm.

19 Claims, No Drawings

METHOD FOR REDUCING COMBUSTION CHAMBER DEPOSITS FROM AN INTERNAL COMBUSTION ENGINE

FIELD OF THE INVENTION

This invention relates to a method for reducing combustion chamber deposits in internal combusion engines. It is well accepted that all gasolines, with or without an octane requirement control additive will result in unwanted deposits formed on the internal cylinder walls and piston heads of internal combustion engines. The same are undesirable because they result in an octane requirement increase, an increase in nefarious engine emissions (such as hydrocarbons, polynuclear aromatics and nitric oxides) and a loss in ultimate engine power. It is most desirable to provide any type of engine treatment technique or method for deadhesion, which thereby causes removal of these deposits.

The change from leaded fuel to unleaded fuel has brought about the development of a whole new generic class of octane requirement reducers. Examples of such are the amine-type additives and amine-urea type, such as an N,N-di(N,N'-dibutyl-3-aminopropyl) urea detergent additive. It has been found that these latter type of additives result in a totally different type of unwanted deposit in the combustion chamber of an internal combustion engine which surprisingly have been found to be very sensitive to liquid water deadhesion.

One of the problems encountered in in situ removal of these deposits is injection of a deadhesion agent which will remove the deposits yet will not have an undesirable deleterious effect upon the cylinder walls or piston heads of the internal combustion engine. And it is totally impractical to manually remove the cylinder head from the block and thereby treat the piston and cylinder head to deadhere manually the unwanted deposits.

OBJECTS AND EMBODIMENTS

An object of this invention is to provide an easy method to remove combustion chamber deposits in an internal combustion engine.

Another object of this invention is to provide a method to remove combustion chamber deposits resultant from the use of an amineurea type detergent additive in gasoline in concentrations of at least 50 ppm.

Yet another object of this invention is to provide a method of removing combustion chamber deposits utilizing water or water mixed with a hydrocarbon diluent for removal of the deposits without damage to the internal elements of the engine.

Yet another embodiment of this invention resides in a method of removing combustion chamber deposits from an internal combustion engine at cold running temperatures of the engine well before the engine attains fully warmed-up temperatures.

One embodiment of this invention resides in a method of reducing internal combustion engine deposits in an internal combustion engine derivative of the internal combustion of a gasoline range hydrocarbon having an additive, in a concentration of at least 50 ppm, said additive being a substituted urea compound having at least one nitrogen atom in at least one of said substituents on either side of the urea moiety, which method comprises injecting an aqueous deadhering agent through an injection means to said internal combustion engine at cold cranking conditions for a period of time sufficient to deadhere at least a portion of said deposits.

Another embodiment of this invention resides in an in situ method of deadhering combustion chamber deposits which are formed by the internal combustion of a gasoline boiling range hydrocarbon having a di-substituted urea additive having at least one nitrogen atom in at least one of said substituents and wherein said additive is present in a concentration of from at least 50 ppm, which method comprises starting said internal combustion engine and terminating said internal combustion in said internal combustion engine before the temperature in said internal combustion engine reaches 65° C. and restarting and restopping said internal combustion engine at least one more time to permit the condensate water in liquid phase to deadhere said engine deposits.

BRIEF DESCRIPTION OF THE INVENTION

Surprisingly, applicants have discovered that water is a selective deadhering agent for combustion chamber deposits derivative of a gasoline additive containing at least three nitrogen atoms wherein the additive is present in a concentration of at least 50 ppm.

DETAILED DESCRIPTION OF THE INVENTION

This invention is applicable to all internal combustion engines which burn gasoline in air or diluted air to convert the same to energy which is then mechanically transmitted to operate a moving vehicle. The internal combustion engine can have but one cylinder or as many as twelve cylinders. It is preferred that each respective cylinder possess an aqueous injection means to provide access of water or the aqueous solution to the internal components of the engine. The injection means comprise but are not limited to injection ports through the spark plug aperatures of the internal combustion engine, through the carburetor or intake ports or to another ancillary port in the side wall of each combustion chamber. It is also possible to intermittenly add a quantity of water from a separate reservoir at any time to ensure that the water will be present at subsequent cold start-up conditions. And the latter is herein defined as the cranking or running of the engine before it develops an internal surface temperature of 65° C. It is also possible to add water in the vaporous phase at the shut off of a hot running engine to insure that when the engine is started at cold start conditions that liquid water will be present to deadhere the combustion chamber deposits.

It is also possible that the water can be generated in situ. During initial combustion of the gasoline-range hydrocarbon and air, water is formed as a condensate by-product. This water, in the liquid form at cold start temperature conditions, can be used as the source of the water for the de-adhesion of the combustion chamber deposits. It is however necessary to form this water while not allowing the engine to increase to a temperature of greater than 65° C. This may be done by continual stop and start of the engine in a carefully controlled pattern so as to provide water for a sufficient amount of time to accomplish its deadhering function. It has been found that utilizing this method will require at least one and possibly up to four starts of the engine without reaching 65° C. within the internal combustion engine surfaces.

The aqueous stream which is added to the combustion chamber can be pure water with or without minerals present therein. The aqueous stream can also be a combination of water and a diluent such as a lower alkyl ketone. The same may be exemplified by any ketone having from 1 to 10 carbon atoms on the alkyl moiety on either side of the carbonyl moiety such as acetone, methyl ethyl ketone, methyl isopropyl ketone, diisopropyl ketone, isopropyl hexyl ketone, dioctyl ketone, octyl nonyl ketone, nonyl decyl ketone, etc.

It has surprisingly been found that the water deadhesion characteristics are only effective for a combustion deposit derivative of a di-substituted urea additive in a concentration of over 50 ppm. Also, the deadhesion is found to be surprisingly successful when the disubstituted urea additive is present in a concentration of over 150 ppm. For a reason not yet fully understood, the presence of three and preferably four nitrogen atoms in the additive results in a specifically unique combustion chamber deposit. These ureas are preferably disubstituted ureas although a mono-substituted urea will also form these selective chamber deposits. These amine-ureas additives are represented by the following formula:

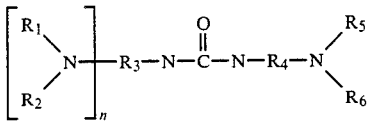

wherein n is equal to 0 or 1; and when n is equal to 0, $R_3$, $R_5$ and $R_6$ are equal to an alkyl moiety having from 1 to 10 carbon atoms, an arylalkyl moiety or an aryl moiety and $R_4$ is an alkylene moiety having from 1 to 10 carbon atoms and where n is equal to 1, $R_1$, $R_2$, $R_5$ and $R_6$ are equal to an alkyl moiety having from 1 to 10 carbon atoms, an arylalkyl moiety or an aryl moiety and $R_3$ and $R_4$ are alkylene moieties having from 1 to 10 carbon atoms. Preferably, $R_3$ and $R_4$ are alkylene moieties having from 1 to 10 carbon atoms. The most notorious amine-urea additive is N,N-di(N',N'-dibutyl-3-aminopropyl) urea.

As the water contacts this particular type of amine-urea derived deposit it acts differently than when it contacts other deposits derivative of additives having fewer than three nitrogen atoms and the additive and water also acts differently in regard to deposits formed even with a three-nitrogen atom amine-urea additive where same is present in a concentration of less than 50 ppm. It can only be surmised that the combustion chamber deposits form as a function of the nitrogen atoms existent during combustion and their relationship in weight to the components of the overall additive. For example, N,N-di-(N',N'-diethyl aminoethyl) urea has a far greater weight of nitrogen relative to the total weight of the compound than does N-polyisobutenyl-N',N'-dimethyl-1,3-propanediamine. It was also surprising that in inspection of this deadhesion that the deposits did not merely deadhere but actually seemed to suddenly "pop off" the metal substrate. It is not fully understood why this violent deadhesion takes places although it is surmised at this time that some type of reaction occurs between the water deadhesion agent and the particular deposit so as to expand and cause sudden and violent expulsion of the deposit from the metal surface.

As demonstrated in the following examples and in Table 1, a large portion of certain deposits will not be removed if either of the two critical limitations of the three nitrogen atoms and minimum concentration are absent. However, it has been determined that an unexpected amount of deposit is removed when these two conjunct parameters in the gasoline are present to develop these deposits.

EXAMPLES

These examples are given as being illustrative of the instant invention and are not to be construed as a limitation thereupon. Example I succinctly shows that water does have a deadhesion effect upon certain combustion deposits in an internal combustion engine. Example II demonstrates that this de-adhesion technique is selective for combustion chamber deposits which have been established through use, and preferably long term use, of an substituted amine urea type detergent additive.

EXAMPLE 1

A V-8 301 CID Pontiac engine from a 1979 Pontiac was mounted on a dynamoneter test stand. The engine was operated from clean conditions utilizing regular unleaded gasoline containing the additive N-polyisobutenyl,N',N'-dimethyl-1,3-propanediamine (two nitrogen atoms) for the equivalent of 11,300 miles. During this time the octane requirement of the engine increased from 90.0 to 98.4 RON. At this point the engine was subjected to a cold start four different times from 2 to 4 seconds, with at least four hours down time between each cold start-stop cycle. During each cycle fiberscopic inspections of the eight combustion chambers showed that deposits began de-adhering subsequent to the second cycle. After the fourth cycle most of the deposits from both the pistons and the cylinder heads were peeled off. The octane requirement of the engine was reduced 4.4 octane numbers simply by this start-stop technique.

This experiment establishes that the octane requirement of vehicles, especially those with long term use, can be improved by the simple cold-engine start-stop technique.

EXAMPLE 2

In this example a 1981 Ford 2.3 liter 4-cylinder engine was mounted in a laboratory dynamometer cell to closely approximate the conditions typical in automotive engines. Tests were run on the Ford engine beginning with a clean combustion chamber with various gasoline additives in various concentrations. These additives are exemplified in Table 1. After the engine was operated at cyclic conditions and after all of the fifty gallons of fuel was consumed, the cylinder head was removed and a 50-50 water/acetone solution was brushed on the piston top and cylinder head deposits. (The acetone component is a mere diluent and had no effect but for combat of the oily film present on the deposits.) After three applications of the solution, an estimate was made of the quantity of deposits which had de-adhered from the piston top without stiff brushing or scrapping. The results derived by a visual inspection and estimation of combustion chamber deposits are set forth in Table I.

TABLE I

| Test No. | Additive | Concentration of Additive in Unleaded Fuel in ppm | % of Piston Top Deposit Removed |
|---|---|---|---|
| 1 | NONE | UNLEADED FUEL ONLY | NONE |
| 2 | N—polyisobutenyl-N',N'—dimethyl-1,3-propanediamine | 40 | NONE |
| 3 | N,N,—di-(N',N',—di-methyl-aminomethyl) urea | 150 | 30 |
| 4 | N,N—di-(N',N'—dibutyl-3-aminopropyl) urea | 300 | 90 |
| 5 | N,N—di-(N',N'—dibutyl-3-aminopropyl) urea | 15 | NONE |
| 6 | N,N—di(N',N'—dibutyl-3-aminopropyl) urea | 150 | 85 |
| 7 | N,N—di-(N',N'—dibutyl-3-aminopropyl) urea | 60 | 30 |
| 8 | N,N—di-(N',N'—dibutyl-3-aminopropyl) urea/N—polyisobutenyl-N',N'—dimethyl-1,3-propane-diamine | 150/40 | 60 |
| 9 | N—polyisobutenyl-N',N'—dimethyl-1,3-propanediamine | 160 | 15 |
| 10 | N—polyisobutenyl-N,N—dimethyl-1,3-propanediamine HVI 65 210° F. | 64/200 | 10 |
| 11 | Base fuel followed by/ N,N—di-(N',N'—dibutyl-3-aminopropyl) urea | 0/150 | 65 |
| 12 | N—butyl-N'—phenylisobutyl urea | 150 | NONE |
| 13 | N—butyl-N'—(N'',N''—diethyl-2-aminoethyl) urea | 150 | 25 |
| 14 | N,N—di-(N',N'—diethyl-2-aminoethyl) urea | 150 | 85 |
| 15 | Reaction product of N,N—dimethyl-1,3-propane-diamine and butyl isocyanate | 150 | 30 |
| 16 | Reaction product of phenyl isocyanate and 2,2'-diethyldihexylamine | 150 | 30 |
| 17 | N—phenyl-N'—N'',N''—dimethyl-3-aminopropyl urea | 150 | 75 |
| 18 | N,N—di-(N',N' diethyl-2-aminoethyl) urea | 150 | 65 |
| 19 | N—phenyl-N'—t-butyl urea | 150 | 70 |

Test Nos. 3, 4, 6, 7 and 8, 11–14, should be compared with Test 1, 2, 4, 5, 9, 10, 15, 16 and 17 which shows that the presence of deposits derivative of additives with at least three and preferably four nitrogen atoms was easily removed in a large percentage by a water-acetone additive as long as the concentration of the compounds containing the three nitrogen atoms was maintained at at least 50 ppm. It is unsure what caused the large deadhesion for the N-phenyl-N-t-butyl urea of Test 19 except to surmise that both were an aberration of the other results.

It was surprising and unexpected that the water would have little effect upon the deposit resultant from the use of an additive with two nitrogen atoms versus deposits derivative of three and preferably at least four nitrogen atoms. It is necessary in internal combustion engines to utilized these nitrogen-containing detergent additives to insure clean carburetors. It would therefore be most beneficial if the four nitrogen atom additives could be used to clean carburetors and yet have a simple method to deadhere the nefarious combustion chamber deposits derivative thereof.

What we claim as our invention is:

1. A method of reducing internal combustion chamber deposits in an internal combustion engine, said deposits derived from internal combustion of a gasoline range hydrocarbon having an additive in a concentration of at least 50 ppm, said additive being a di-substituted urea compound having at least one nitrogen atom in at least one of said substituents on either side of the urea moiety, which method comprises injecting an aqueous deadhering agent through an injection means to said internal combustion engine at cold cranking conditions for a period of time sufficient to deadhere at least a portion of said deposits.

2. The method of claim 1 wherein said aqueous deadhering agent comprises water without any additional solvent.

3. The method of claim 1 wherein said aqueous deadhering agent comprises a solution of water and a lower alkyl ketone diluent.

4. The method of claim 3 wherein said lower alkyl ketone is present in an amount of from about 25 to about 75 percent by weight.

5. The method of claim 4 wherein said lower ketone is methyl ethyl ketone.

6. The method of claim 4 wherein said lower alkyl ketone is methyl isopropyl ketone.

7. The method of claim 1 wherein said substituted urea compound is N,N-di-(N,N'-dibutyl-3-aminopropyl) urea.

8. The method of claim 1 wherein said substituted urea compound comprises N,N-di-(N',N'-dihexyl-5-aminoheptyl) urea.

9. The method of claim 1 wherein said substituted urea compound comprises N,N-di-(N'N'-diethyl-2-aminoethyl) urea.

10. The method of claim 1 wherein said injection means comprises an injection port through a spark plug aperature, carburetor or intake ports.

11. The method of claim 1 wherein said injection means comprises an injection port through the side wall of at least one combustion cylinder.

12. The method of claim 1 wherein said additive is present in said gasoline range hydrocarbon in a concentration of at least 150 ppm di-substituted urea compound.

13. The method of claim 11 wherein said internal combustion engine has at least four cylinders each having said injection port.

14. The method of claim 1 wherein said additive is represented by the formula:

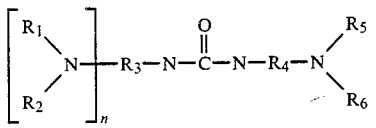

wherein n is equal to 0 or 1 and when n is equal to 0, $R_3$, $R_5$ and $R_6$ are equal to an alkyl moiety having from 1 to 10 carbon atoms, an arylalkyl moiety or an aryl moiety and $R_4$ is an alkylene moiety having from 1 to 10 carbon atoms and where n is equal to 1, $R_1$, $R_2$, $R_5$ and $R_6$ are equal to an alkyl moiety having from 1 to 10 carbon atoms, an arylalkyl moiety or an aryl moiety and $R_3$ and $R_4$ are alkylene moieties having from 1 to 10 carbon atoms.

15. An in situ method of deadhering combustion chamber deposits which are formed by the internal combustion of a gasoline range boiling hydrocarbon having a di-substituted urea additive having at least one nitrogen atom in at least one of said substituents and wherein said additive is present in a concentration of from at least 50 ppm, which method comprises starting said internal combustion engine to form a water condensation product in the internal combustion engine and terminating said internal combustion in said internal combustion engine before the temperature of said internal combustion engine surfaces reaches 65° C. and restarting and restopping said internal combustion engine at least one more times in said sequence to permit the condensate water in liquid phase to deadhere said engine deposits.

16. The method of claim 15 wherein said additive is N,N-di-(N',N',-dimethyl-aminomethyl) urea which is present in a concentration of at least 150 ppm.

17. The method of claim 15 wherein said additive is N,N-di-(N',N'-dibutyl-3-aminopropyl)urea which is present in a concentration of at least 150 ppm.

18. The method of claim 15 wherein said additive is N,N-di-(N',N'-diethyl-2-aminoethyl) urea which is present in a concentration of at least 150 ppm.

19. The method of claim 15 wherein said additive is N-phenyl-N'-N'',N''-dimethyl-3-aminopropyl urea which is present in a concentration of at least 150 ppm.

* * * * *